US007682013B2

(12) United States Patent
Hoshino

(10) Patent No.: US 7,682,013 B2
(45) Date of Patent: Mar. 23, 2010

(54) INKJET RECORDING APPARATUS AND CONTROL METHOD OF INKJET RECORDING APPARATUS

(75) Inventor: Yoshihide Hoshino, Hachioji (JP)

(73) Assignee: Konica Minolta Medical & Graphic, Inc., Tokyo (JP)

( * ) Notice: Subject to any disclaimer, the term of this patent is extended or adjusted under 35 U.S.C. 154(b) by 398 days.

(21) Appl. No.: 11/172,780

(22) Filed: Jul. 1, 2005

(65) Prior Publication Data

US 2006/0227194 A1 Oct. 12, 2006

(30) Foreign Application Priority Data

Apr. 8, 2005 (JP) ..... 2005-112060

(51) Int. Cl.
*B41J 2/01* (2006.01)

(52) U.S. Cl. ..... 347/102; 347/11; 347/15; 347/19; 347/43; 347/96; 355/31; 385/115; 522/81

(58) Field of Classification Search ..... None
See application file for complete search history.

(56) References Cited

U.S. PATENT DOCUMENTS 4,630,076 A * 12/1986 Yoshimura ..... 347/43
5,933,164 A * 8/1999 Sato et al. ..... 347/43
5,995,193 A * 11/1999 Stephany et al. ..... 355/31
6,805,439 B2 * 10/2004 Maeda et al. ..... 347/96
7,114,660 B1 * 10/2006 Cok et al. ..... 235/494
7,140,711 B2 * 11/2006 Nerad et al. ..... 347/19
2002/0149660 A1 * 10/2002 Cleary et al. ..... 347/102
2003/0011670 A1 * 1/2003 Shirakawa ..... 347/102
2003/0142168 A1 * 7/2003 Suzuki et al. ..... 347/43
2003/0189609 A1 * 10/2003 Ishikawa ..... 347/11
2005/0190248 A1 * 9/2005 Konno et al. ..... 347/102
2005/0200679 A1 * 9/2005 Falser et al. ..... 347/104
2006/0233501 A1 * 10/2006 Sampson ..... 385/115

FOREIGN PATENT DOCUMENTS

| | | |
|---|---|---|
| JP | 7195715 | 8/1995 |
| JP | 2001310454 | 11/2001 |
| JP | 2003025613 | 1/2003 |
| JP | 2003191601 | 7/2003 |

* cited by examiner

*Primary Examiner*—Matthew Luu
*Assistant Examiner*—John P Zimmermann
(74) *Attorney, Agent, or Firm*—Lucas & Mercanti, LLP

(57) ABSTRACT

The inkjet recording apparatus has a color ink recording head to jet color ink toward a recording medium; an invisible ink recording head to jet invisible ink toward the recording medium; and a light irradiating device to irradiate light toward the recording medium to cure the ink. A control section causes the color ink to be jetted then the light irradiating device irradiates the color ink, thereafter the invisible ink is jetted, and finally the light irradiating device irradiates the invisible ink after a lapse of a certain time from the invisible ink jetting.

26 Claims, 6 Drawing Sheets

*FIG.5A*

| | | | | | |
|---|---|---|---|---|---|
| 1 | 5 | 3 | 1 | 5 | 3 |
| 4 | 2 | 6 | 4 | 2 | 6 |
| 1 | 5 | 3 | 1 | 5 | 3 |
| 4 | 2 | 6 | 4 | 2 | 6 |

*FIG.5B*

| | | | | | |
|---|---|---|---|---|---|
| 7 | 5 | 3 | 7 | 5 | 3 |
| 4 | 2 | 6 | 4 | 2 | 6 |
| 7 | 5 | 3 | 7 | 5 | 3 |
| 4 | 2 | 6 | 4 | 2 | 6 |

*FIG.6A*

| | | | | | |
|---|---|---|---|---|---|
| 1 | 5 | 3 | 1 | 5 | 3 |
| 4 | 2 | 6 | 4 | 2 | 6 |
| 1 | 5 | 3 | 1 | 5 | 3 |
| 4 | 2 | 6 | 4 | 2 | 6 |

*FIG.6B*

| | | | | | |
|---|---|---|---|---|---|
| 7 | 5 | 3 | 7 | 5 | 3 |
| 4 | 2 | 6 | 4 | 2 | 6 |
| 7 | 5 | 3 | 7 | 5 | 3 |
| 4 | 2 | 6 | 4 | 2 | 6 |

INKJET RECORDING APPARATUS AND CONTROL METHOD OF INKJET RECORDING APPARATUS

CROSS REFERENCE TO RELATED APPLICATIONS

The entire disclosure of Japanese Patent Application No. Tokugan 2005-112060 which was filed on Apr. 8, 2005, including specification, claims, drawings, and summary is incorporated herein by reference in its entirety.

BACKGROUND OF THE INVENTION

1. Field of the Invention

The present invention relates to an inkjet recording apparatus and a control method of an inkjet recording apparatus, and more particularly to an inkjet recording apparatus and a control method of an inkjet recording apparatus that record images using invisible ink.

2. Description of the Related Art

There have been widely known an inkjet type recording apparatus (hereinafter referred to as "inkjet recording apparatus") as a recording apparatus that can correspond to the demand of small quantity and various kinds of recording suited to the occasion. Inkjet recording apparatuses generally jet droplets of ink from nozzles formed on a recording head at the surface facing a recording medium, land and fix the ink on the recording medium to record images on the medium. The inkjet recording apparatus differs from image recording method used in a conventional gravure printing method or flexography printing method, and has such a feature that it can correspond to the demand of small quantity printing easily and speedily because it does not need a plate making process. Further, the inkjet recording apparatus has such an advantage that it has a low noise level and can record colored images easily by using multi-color inks.

Recently, there has been also known an inkjet recording apparatus that uses photo-curable ink, as an inkjet recording apparatus that can deal with various kinds of recording mediums (refer to, for example, Japanese Non-examined Patent Publication, JP-Tokukai-2001-310454A). This type of inkjet recording apparatus jets droplets of photo-curable ink containing a photo-initiator having a predetermined sensitivity to light such as ultraviolet rays, irradiates the ink deposited on a recording medium to cure and fix the ink on the medium. This type of inkjet recording apparatus rapidly cures the ink by irradiation of light after landing of ink droplets, therefore prevents the ink from soaking or bleeding in the recording medium. This characteristic allows image recording not only on plain paper but also on a recording medium made of plastic or metal that does not have an ink-receiving layer and does not absorb ink at all.

Among such inkjet recording apparatuses, a serial-type inkjet recording apparatus, while reciprocating recording heads and light irradiating devices in a width direction of the recording medium, the recording heads jet ink droplets and the light irradiating devices irradiate the deposited ink to fix the ink on the medium. Because the time from jetting of ink from a recording head to irradiation of light varies according to the forward and backward movement in the reciprocating movement, there occurs a difference in a color tone and gloss of recorded images in the main scanning direction due to the variation in dot sizes and dot-connection states. For solving this problem, there has been known such a technology that the degree of dot overlap does not vary in both forward and backward directions in the main scanning direction, by disposing two sets of recording heads, which jet droplets of plural color inks, symmetrically in the main scanning direction (refer, for example, to JP-3248704B).

There has been also known such a technology that jetting amount of ink is adjusted according to ink penetrance into a recording medium in an inkjet recording apparatus that uses water-base ink for recording images (refer, for example, to JP-Tokukai-2003-25613A).

Further, there are sometimes found variation of images, unevenness due to difference in applied ink quantity, partial excessive gloss, etc. in a case that photo-curable ink is used. These irregularities are obviously found in the recorded area where large quantity of ink is applied. The reason for these irregularities is considered as follows. When water-base ink or oil-base ink is used for recording, most of ink is absorbed into a recording medium, but when photo-curable ink is used, the ink remains on the recording medium and is cured with the ink-deposited portion protruded, which produces an uneven surface of the recorded images due to variation of the deposited ink quantity.

For solving this problem, such an inkjet recording apparatus is disclosed that, by using two types of inks, one containing a coloring material (hereinafter, "color ink") and the other containing no coloring material (hereinafter, "invisible ink"), images are recorded so that both types of inks are deposited on the recording medium with uniform volume in total (refer, for example, to JP-2003-191601A). Use of such inkjet recording apparatus permits a uniformly deposited ink quantity per unit area, thereby suppressing uneven gloss caused by variation of ink quantity, and improving the durability of the recorded images with the recording medium covered by the invisible ink.

However, the technology described in JP-3248704B needs to mount twice as many recording heads as usual one, thereby making an apparatus larger in size and increased in weight.

The technology described in JP-Tokukai-2003-25613A requires adjustment of jetting amount of ink according to the ink penetrance when using the water-base ink that permeates into a recording medium, and is not applicable to photo-curable ink that is hard to permeate into the recording medium, and that the size and connection state of ink dots are affected by a variation in curing timing by irradiation of light and by the intensity of irradiated light.

The technology described in JP-Tokukai-2003-191601A can obtain a certain level of uniform gloss in recorded images, but cannot obtain a desired level of uniform gloss, that is, cannot determine a jetting amount of invisible ink to realize the desired level of gloss.

In the serial-type inkjet recording apparatus using photo-curable ink, the time from landing of invisible ink to the light irradiation in a bidirectional scanning varies according to the forward and backward movements along the main scanning direction, thus leading to a problem that uneven gloss occurs caused by the uneven dot sizes of invisible ink.

SUMMARY OF THE INVENTION

The invention has been developed in view of the above-described circumstances, and an object of the invention is to provide an inkjet recording apparatus capable of preventing uneven gloss.

For solving the problems, in accordance with the first aspect of the present invention, the inkjet recording apparatus comprises:

a color ink recording head to jet color ink toward a recording medium;

an invisible ink recording head to jet invisible ink toward the recording medium;

a light irradiating device to irradiate light toward the recording medium to cure ink;

a moving section to reciprocate the color ink recording head, the invisible ink recording head and the light irradiating device in a width direction of the recording medium;

a conveying section to convey the recording medium; and a control section to perform a control so that while the color ink recording head, the invisible ink recording head and the light irradiating device are moved, the color ink recording head jets the color ink, then the light irradiating device irradiates the color ink with light, and thereafter the invisible ink recording head jets the invisible ink, then the light irradiating device irradiates the invisible ink with light after a lapse of a certain time from the invisible ink jetting.

Thus, under the control of the control section, the color ink is jetted while the moving section moves the color ink recording head, the invisible ink recording head and the light irradiating device, and then irradiated, and thereafter the invisible ink is jetted, and irradiated after a lapse of a certain time from the jetting of the invisible ink. Accordingly, the time from landing of the invisible ink to irradiation of light becomes uniform, therefore the dot sizes become uniform regardless of moving directions of the invisible ink recording head, thereby uneven gloss is prevented and image quality can be improved.

Preferably, the control section controls the color ink recording head to jet the color ink in a bidirectional scanning in a reciprocating movement by the moving section, and controls the invisible ink recording head to jet the invisible ink only in one directional scanning in the reciprocating movement by the moving section.

Thus, under the control of the control section, the color ink is jetted in bidirectional scanning of the color ink recording head reciprocated by the moving section, and the invisible ink is jetted only in one directional scanning of the invisible ink recording head in reciprocating movement driven by the moving section. Accordingly, the time from jetting of the invisible ink to irradiation of light becomes uniform, therefore the invisible ink can be cured with uniform dot sizes, to thereby prevent uneven gloss and improve image quality.

Preferably, the control section performs a control so that a length of an area in a conveying direction, on which the invisible ink is jetted by the invisible ink recording head, in one time of scanning is almost double a length of an area in the conveying direction on which the color ink is jetted by the color ink recording head.

With this control, the maximum number of recorded pixels per area of the color ink jetted from the color ink recording head with bidirectional scanning can be almost equal to the maximum number of recorded pixels per area of the invisible ink jetted from the invisible ink recording head with one direction scanning. Accordingly, images can be recorded with even gloss without lowering recording speed.

Preferably, the color ink recording head and the invisible ink recording head are mounted on one same carriage, and the moving section reciprocates the carriage in the width direction of the recording medium.

Thus, the color ink recording head and the invisible ink recording head are mounted on one same carriage, and each recording head can jet a predetermined ink during reciprocation of the carriage. As a result, one moving section allows two kinds of recording heads to record images, thereby the moving section can be made simple and small-sized, and made the cost reduced.

Preferably, the light irradiating device comprises a first light irradiating device and a second light irradiating device which are disposed at both sides of the carriage, the invisible ink recording head comprises a first invisible ink recording head and a second invisible ink recording head which are disposed on the carriage symmetrically.

Thus, the first and the second invisible ink recording heads are disposed on the carriage symmetrically, and the first and the second light irradiating devices are disposed at both sides of the carriage, therefore the distance from the invisible ink recording head to the light irradiating device locating at the rear side in a moving direction becomes equal for both of the moving directions. Accordingly, the time from landing onto the recording medium of the invisible ink jetted from the invisible ink recording head, to irradiation of light by the irradiating device locating at the rear side in the moving direction, becomes equal for both of the moving directions. In other words, the invisible ink jetted from the invisible ink recording head is irradiated after a lapse of predetermined time from landing on the recording medium, thereby dot sizes of invisible ink become even, and uneven gloss can be prevented.

Preferably, the control section controls scanning to switch from a first pair of the first invisible ink recording head and the first light irradiating device to a second pair of the second invisible ink recording head and the second light irradiating device or vise versa in each scanning, the first pair and the second pair are used in forward and backward directions of scanning, respectively.

Thus, the invisible ink recording head and the light irradiating device to be used in each forward or backward direction of scanning are changed for each scanning, which leads to a uniform time from landing on the recording medium to irradiation of light. This uniform time makes the dot sizes of invisible ink even, and permits prevention of uneven gloss.

Here, there may be two kinds of combinations of the invisible ink recording head and the light irradiating device to be used, but because dot sizes of invisible ink vary according to the distance from the light irradiating device, the invisible ink recording head and the light irradiating device to be used may be determined according to the gloss desired by a user.

Preferably, the control section controls the number of pixels per unit area recorded by the invisible ink recording head so as to be 0.6-0.8 times the maximum number of pixels per unit area recordable by the invisible ink recording head.

With this control, the invisible ink is jetted from the invisible ink recording head by moderately thinned out quantity, which can prevent adjacent dots of invisible ink from connecting with each other the connection caused by uneven jetting from the invisible ink recording head.

Preferably, the control section controls the number of pixels per unit area recorded by the invisible ink recording head so as to be not more than 0.5 times the maximum number of pixels per unit area recordable by the color ink recording head.

With this control, even if the invisible ink is jetted only in one directional scanning of the invisible ink recording head, images are recorded at almost the same speed as of the color ink recording head. Accordingly, images can be recorded with even gloss without reducing recording speed.

Preferably, the control section controls the number of pixels per unit area recorded by the invisible ink recording head so as to be not more than 0.25 times the maximum number of pixels per unit area recordable by the color ink recording head.

With this control, even if the invisible ink is jetted only in one directional scanning of the invisible ink recording head, images can be recorded at almost the same speed as of the color ink recording head, and adjacent dots of invisible ink can be prevented from connecting with each other, the connection caused by uneven jetting from the invisible ink recording head.

Preferably, the control section randomly determines a landing position of the invisible ink per unit area jetted from the invisible ink recording head.

With this control, when the invisible ink is jetted from the invisible ink recording head by moderately thinned out quantity, the ink is jetted so that a landing position of the invisible ink per unit area is random. Accordingly, there can be reduced uneven gloss caused by variation of landing positions due to bend of nozzles or the like.

Preferably, a recorded resolution by the color ink recording head is not less than a recorded resolution by the invisible ink recording head.

With this structure, the recording speed of the invisible ink recording head is prevented from lowering than that of the color ink recording head, and therefore images can be recorded with even gloss without reducing recording speed.

Preferably, a recorded resolution by the color ink recording head is 2n (n is a natural number) times a recorded resolution by the invisible ink recording head.

With this structure, the invisible ink can be jetted only in one directional scanning of the invisible ink recording head while the color ink is jetted in bidirectional scanning of the color ink recording head. Accordingly, while images are recorded by one directional scanning of the invisible ink recording head, images can be recorded with even gloss without reduction of recording speed.

Preferably, the control section is connected to an input section to input an instruction, and wherein the control section performs a control to change the number of pixels per unit area recorded by the invisible ink recording head based on the instruction from the input section.

With this control, the invisible ink recording head jets invisible ink with the number of pixels per unit area changed based on the instructions from the input section. This jetting changes a ratio of recorded area of the invisible ink per unit area, to thereby allow the gloss to be changed, and also prevent uneven gloss and improve image quality.

Preferably, the control section adjusts ink quantity per one pixel by the invisible ink recording head to almost equal to or less than ink quantity per one pixel by the color ink recording head.

With this control, the time for jetting invisible ink from the invisible ink recording head to form one pixel is prevented from exceeding the time for jetting color inks from the color ink recording head to form one pixel, therefore images can be recorded without reducing recording speed with uniform gloss.

Preferably, the control section is connected to an input section to input an instruction, and wherein the control section adjusts ink quantity per one pixel by the invisible ink recording head based on the instruction from the input section.

With this control, ink quantity per one pixel jetted from the invisible ink recording head is adjusted based on the user's instruction from the input section, by adjusting the number of dots forming one pixel or adjusting the ink quantity of one dot. This adjustment of invisible ink quantity instructed by others (e.g. by a user or by an external device) allows gloss to be changed, and allows prevention of uneven gloss and improvement of image quality.

In accordance with the second aspect of the present invention, the control method of an inkjet recording apparatus which includes:

a color ink recording head to jet color ink toward a recording medium;

an invisible ink recording head to jet invisible ink toward the recording medium;

a light irradiating device to irradiate light toward the recording medium to cure ink;

a moving section to reciprocate the color ink recording head, the invisible ink recording head and the light irradiating device in a width direction of the recording medium; and a conveying section to convey the recording medium, the method comprises:

jetting the color ink from the color ink recording head and irradiating the color ink by the light irradiating device, while the moving section moves the color ink recording head, the invisible ink recording head and the light irradiating device;

jetting the invisible ink from the invisible ink recording head; and irradiating the invisible ink by the light irradiating device after a lapse of a certain time from the invisible ink jetting.

With this control method, the color ink droplets are jetted while the moving section moves the color ink recording head, the invisible ink recording head and the light irradiating device, and then irradiated, and thereafter the invisible ink is jetted, and irradiated after a lapse of a certain time from the jetting of ink. Accordingly, the time from landing of invisible ink droplets to irradiation of light becomes uniform, therefore the dot sizes become uniform regardless of moving directions of the invisible ink recording head, thereby uneven gloss is prevented and image quality can be improved.

BRIEF DESCRIPTION OF THE DRAWINGS

The present invention will become more fully understood from the detailed description given hereinafter and the accompanying drawings which are given by way of illustration only, and thus are not intended as a definition of the limits of the present invention, and wherein;

FIG. 5A is a dot-matrix of a color ink in a first band relative to a record starting position on a recording medium according to the first embodiment of the present invention, and FIG. 5B is that in a second band;

FIG. 6A is a dot-matrix of a color ink with invisible ink additively jetted thereon in the first band relative to the record starting position on the recording medium according to the first embodiment of the present invention, and FIG. 6B is that in the second band;

DETAILED DESCRIPTION OF THE PREFERRED EMBODIMENT

A description will now be given of embodiments of an inkjet recording apparatus according to the present invention with reference to the drawings, but the scope of the invention is not limited to the exemplary drawings.

First Embodiment

Figure 1:
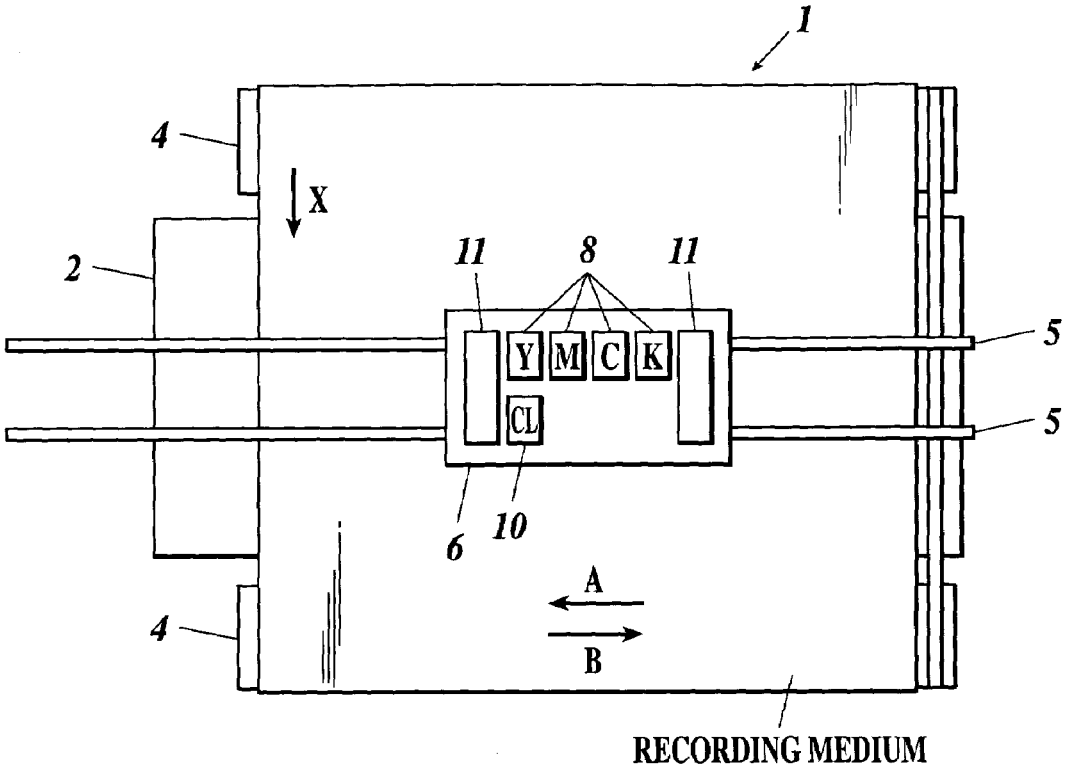
FIG. 1 is a plan view showing an inkjet recording apparatus according to a first embodiment of the present invention.

Referring to FIG. 1, an inkjet recording apparatus 1 according to the embodiment is a serial-type inkjet recording apparatus 1, which comprises a platen 2 formed in a plate shape for supporting a recording medium thereon from its non-recording side.

Provided under the platen 2 is a conveying section 3 (see FIG. 3) for conveying the recording medium in a conveying direction X perpendicular to main scanning directions A and B. The conveying section 3 includes a plurality of conveying rollers 4, 4, which convey the recording medium from the upstream side to the downstream side in the conveying direction X by the rotation of the conveying rollers 4, 4.

Figure 2:
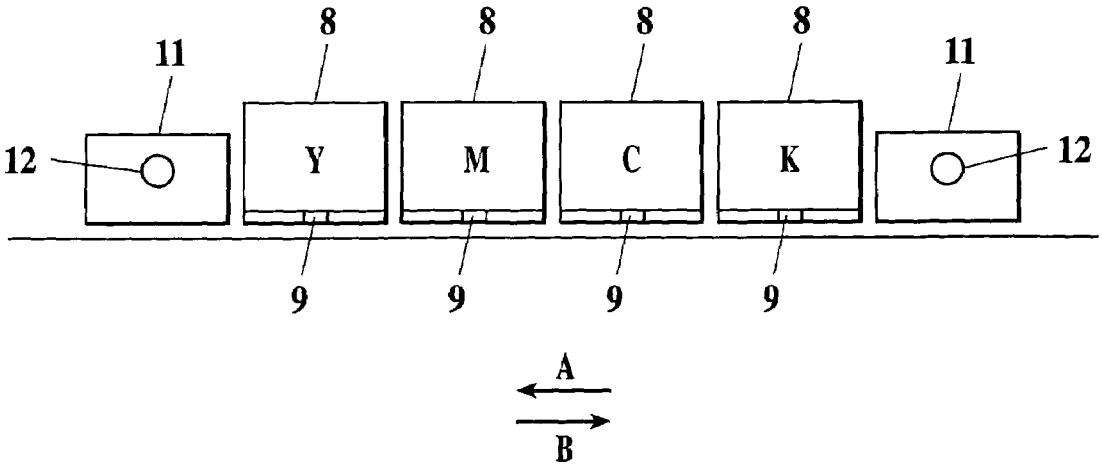
FIG. 2 is a front view of a carriage according to the first embodiment of the present invention.

Provided over the platen 2 are a pair of rod-shaped guide rails 5 and 5 extending in a longitudinal direction of the platen 2. The guide rail 5 supports a carriage 6 as shown in FIG. 2. The carriage 6 is connected with a moving section 7 (see FIG. 3), and able to reciprocate along the guide rails 5 in the main scanning directions A and B. The moving section 7 includes, for example, a motor controlled by a control section 13 (see FIG. 3), and a pulley connecting the carriage 6 and the motor so as to transmit driving force of the motor to the carriage 6.

The carriage 6 has four color ink recording heads 8 . . . mounted thereon corresponding to respective color inks (black (K), cyan (C), magenta (M) and yellow (Y)) used in the inkjet recording apparatus 1 of the embodiment. Each color ink recording head 8 is formed in a near rectangular parallelepiped shape for the outward appearance, and arranged in parallel with each other so that the longitudinal direction is directed along the conveying direction X. Each recording head 8 has a plurality of ink nozzles 9 provided on the surface facing the recording medium and arranged along the conveying direction X with an even space.

The color ink recording heads 8 jet droplets of respective color inks from the ink nozzles 9 based on input image information. Each color ink recording head 8 is connected with an ink tank (not shown) storing its own ink for supplying each color ink thereto. Colors of ink used in the inkjet recording apparatus 1 are not limited to those described above, and colors, such as light yellow (LY), light magenta (LM) and light cyan (LC), may be used for example. In this case, recording heads corresponding to respective colors would be mounted on a carriage.

There is provided an invisible ink recording head 10 for jetting invisible ink over the deposited color inks, the head 10 being mounted on the carriage 6 and at the downstream side in the conveying direction X with respect to the color ink recording head 8 that jets yellow (Y) ink. The invisible ink recording head 10 has similar outside appearance to that of the color ink recording head 8, and is disposed so that the longitudinal direction is directed along the conveying direction X. The invisible ink head 10 also has a plurality of ink nozzles 9, which are provided on the surface facing the recording medium and arranged along the conveying direction X with an even space.

As shown in FIG. 2, there are provided ultraviolet irradiating devices 11 and 11 at both sides of the color ink recording heads 8 and the invisible ink recording head 10 in the scanning directions A and B. Each ultraviolet irradiating device 11 has a light source 12 for radiating ultraviolet rays as the light that cures and fixes the ink droplets deposited on the recording medium.

"Ink" used in the embodiment is photo-curable ink that is cured by irradiation of ultraviolet rays as light, and contains as main compositions at least a polymerizable compound (including known polymerizable compounds), a photo-initiator and a coloring material. The photo-curable ink is broadly categorized into radical-polymerization type ink containing a radical polymerizable compound as a polymerizable compound, and cationic polymerization type ink containing a cationic polymerizable compound as a polymerizable compound, and both types of inks are applicable to the ink for use in the embodiment. Hybrid type ink, which is a mixture of the radical polymerization type ink and the cationic polymerization type ink, may be also applicable to the ink for use in the embodiment. However, because the cationic polymerization type ink, which is little or not inhibited by oxygen in the polymerization reaction, is superior to any other ink in functionality and versatility, it is particularly preferable to use the cationic polymerization type ink. The cationic polymerization type ink is a mixture containing at least a cationic polymerizable compound, such as an oxetane compound, an epoxy compound and a vinyl-ether compound, a photo cationic initiator, and a coloring material.

Applicable to the "recording medium" for use in the embodiment are various kinds of paper, such as plain paper, recycled paper and glossy paper, various fabrics, various non-woven fabrics, and mediums consisting of resin, metal, glass, or the like. As a form of the recording medium, various shapes of mediums, such as roll-shaped, cut-sheet, and plate-shaped mediums, are usable.

A description will be given of the control structure of the inkjet recording apparatus 1 according to the embodiment with reference to FIG. 3.

Figure 3:
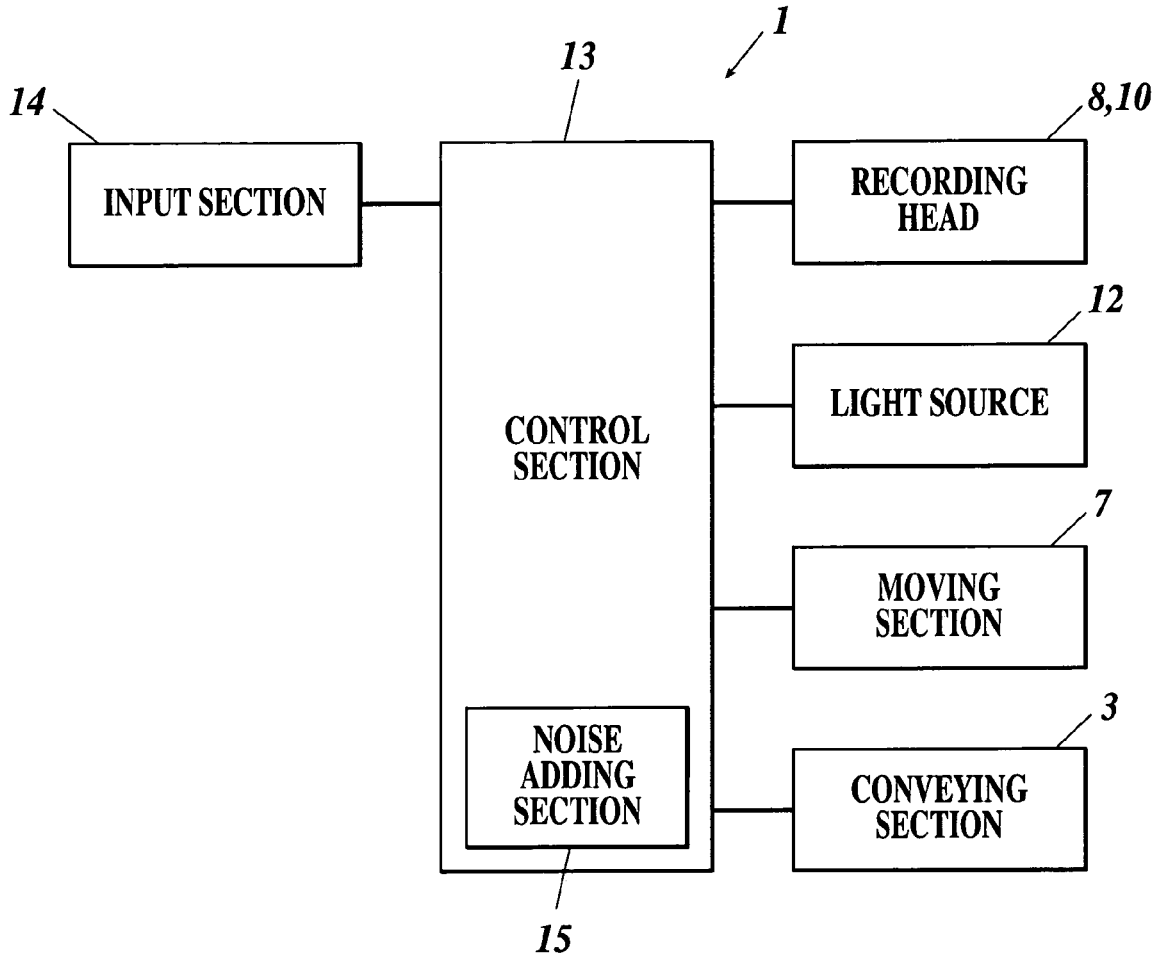
FIG. 3 is a block diagram showing a control structure according to the first embodiment of the present invention.

As shown in FIG. 3, the inkjet recording apparatus 1 comprises the control section 13 which is connected to and controls the moving section 7, the conveying section 3, each recording head and the light source 12. The control section 13 includes, for example, a CPU (central processing unit), a ROM (read only memory) for storing various processing programs, and a RAM (random access memory) for temporarily storing various data such as image data (every component not shown). The processing programs stored in the ROM are developed into the working area of the RAM and executed by the CPU.

The control section 13 is also connected to an input section 14 for inputting to the printer 1 gloss of images, image recording conditions and the like that a user desires. The input section 14 has, for example, a keyboard and an operation panel, and operation of the input section 14 permits the user to select and set the desired gloss and image recording speed and the like. Specifically, the control section 13 adjusts the number of pixels per unit area, which is recorded by the invisible ink recording head 10, or ink quantity per one pixel to adjust the gloss, by jetting the invisible ink while thinning out it. Here, the ink quantity per one pixel is adjusted by adjusting the number of dots of invisible ink composing one pixel, or adjusting ink quantity jetted in one time.

Accordingly, when the user operates the input section 14 so as to record a glossy image, the invisible ink is so jetted as to increase the number of pixels per unit area or the ink quantity per one pixel, thereby increasing the gloss of the image.

The control section 13 controls the moving section 7 so that the carriage 6 scans backward and forward by a constant speed in the scanning directions A and B, and also controls the conveying section 3 so as to convey the recording medium by a predetermined amount in the conveying direction X when a moving direction of the carriage 6 is changed. Here, the conveying amount for one time, conveyed by the conveying section 3, corresponds to the amount of one band width, which will be described later. The control section 13 also controls the light source 12 so as to light during image recording for radiating ultraviolet rays on the color inks and the invisible ink that are jetted during every scanning and deposited on the recording medium.

The control section 13 is adapted to jet the color ink from the color ink recording heads 8, based on image data associated with a recording image sent from an external device, not shown. Here, the control section 13 controls the color ink recording heads 8 so that the jetted color inks can constitute one area with six times of scanning. In other words, the ink nozzles 9 on the color ink recording head 8 are divided into six groups of nozzles, and each group of the nozzles 9 jets the color ink onto the recording medium at every scanning (see FIG. 4). Here, the number of scanning necessary for jetting the color ink to constitute one area is properly changeable, and the nozzles 9 on each color ink recording head 8 are divided into groups and controlled depending on the number of scanning.

On the other hand, the control section 13 is adapted to jet the invisible ink from the invisible ink recording head 10 with adjustment of the number of pixels per unit area to be recorded or adjustment of ink quantity per one pixel. Further, the control section 13 controls the invisible ink recording head 10 so that the invisible ink is jetted only in one directional scanning of the carriage 6. In the embodiment, the color inks are jetted while the color ink recording heads 8 move along the main scanning directions A and B, and the invisible ink is jetted only while the invisible ink recording head 10 moves along the main scanning direction B.

In the embodiment, since the invisible ink recording head 10 is disposed at more downstream side in the conveying direction than the color ink recording heads 8, the recording medium faces first the color ink heads 8, and then the invisible ink head 10. Therefore, after the color inks are fixed to the recording medium, the medium is conveyed in the conveying direction X, and then the invisible ink is deposited thereon.

Here, the control section 13 so controls as to properly thin out the invisible ink jetted from the invisible ink recording head 10. Specifically, the control section 13 controls the invisible ink so that the recorded number of pixels per unit area is 0.6-0.8 times the maximum number of pixels per unit area recordable by the invisible ink head 10. Thus, adjacent dots of deposited invisible ink are prevented from being randomly connected with each other, by properly reducing the number of pixels per unit area recorded by the invisible ink head 10.

Further, the number of pixels per unit area recorded by the invisible ink head 10 is controlled by the control section 13 so as to be not more than 0.5 times the maximum number of pixels per unit area recordable by the color ink head 8. With this control, it is possible to record images with almost the same speed as of the color ink head 8, even if the invisible ink is jetted only in one directional scanning of the invisible ink head 10.

It is preferable that the number of pixels per unit area recorded by the invisible ink head 10 is controlled by the control section 13 so as to be not more than 0.25 times the maximum number of pixels per unit area recordable by the color ink head 8. With this control, it is possible to record images with almost the same speed as of the color ink head 8, even if the invisible ink is jetted only in one directional scanning of the invisible ink head 10, and to prevent the adjacent invisible ink dots from connecting with each other, the connection caused by variation of ink jetting from the invisible ink head 10. Since a precise amount of thinning out the invisible ink within the range described above is determined according to the instruction input by a user through the input section 14, the user can adjust images to a desired level of gloss.

In the case that the resolution in the color ink recording head 8 is equal to that in the invisible ink recording head 10 as in the embodiment, it is preferable that the recorded resolution by the color ink recording head 8 is 2n (n is a natural number) times the recorded resolution by the invisible ink recording head 10. Here, the "resolution in the recording head" is a value based on the nozzle pitch arranged on the recording head, and the "recorded resolution by the recording head" is a value based on an image actually recorded by the recording head.

Further, the control section 13 includes a noise adding section 15, which controls an jetting signal for the invisible ink so as to diffuse randomly, and determines the landing positions of invisible ink per unit area at random, the ink being jetted by the invisible ink recording head 10.

Figure 4:
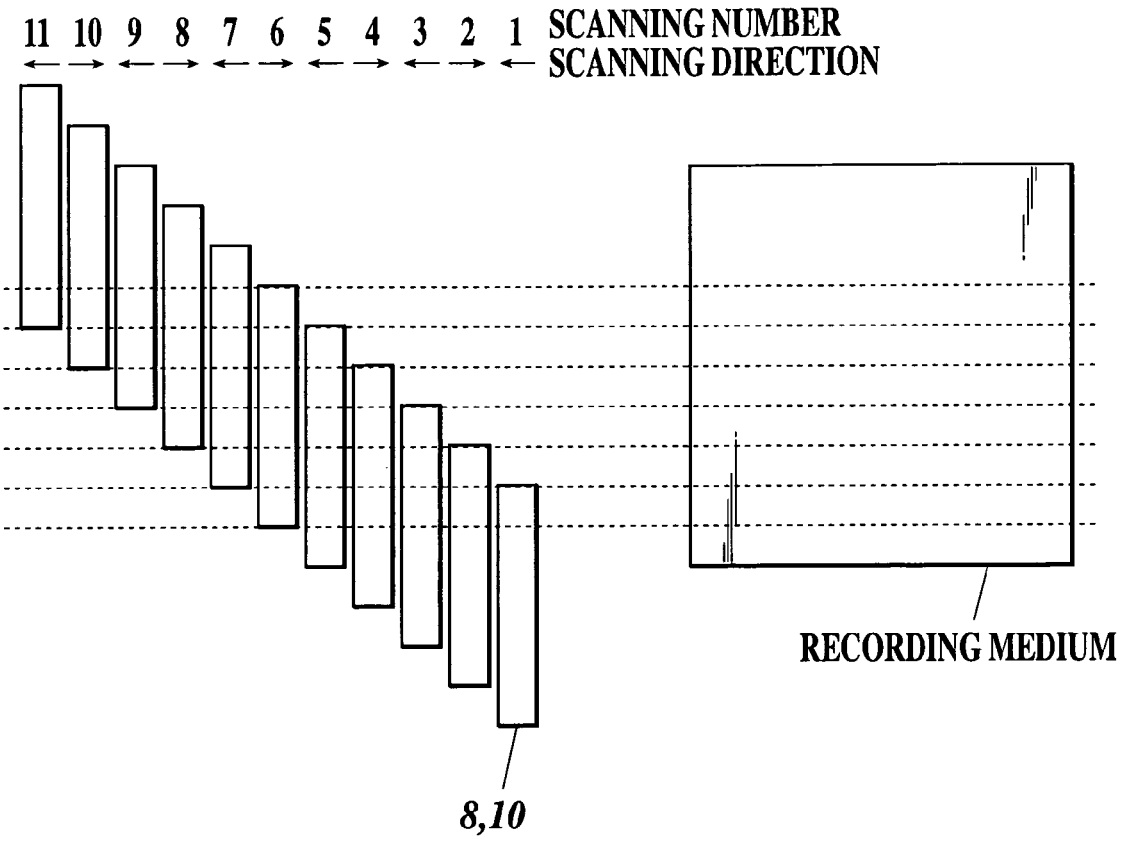
FIG. 4 is an explanatory diagram for explaining a control method of the inkjet recording apparatus according to the first embodiment of the present invention.

Next, a control method of the inkjet recording apparatus according to the embodiment will be explained, exemplifying a process to record one band of an image. Here, it is assumed in the embodiment that the color inks forming one band are jetted by six times of scanning and the invisible ink is jetted by the scanning of even numbers out of consecutive six times of scanning to complete one band of image recording. It is also assumed that the resolution in the color ink head 8 is equal to that in the invisible ink head 10. FIG. 4 illustrates the positional relationship between a recording medium and each scanning of the color ink head 8, with indication of scanning numbers and scanning directions (by arrows) of the color ink head 8.

When image data input from an external device, not shown, is sent to the inkjet recording apparatus 1, the sent image data is stored in the RAM of the control section 13. If a user inputs from the input section 14 various image recording conditions, such as desired gloss and an image recording speed, the control section 13 determines the number of scanning necessary for jetting the color inks to form one area of a recording medium, and the number of pixels per unit area of the invisible ink so as to conform to various conditions such as the input information, and then starts recording images.

Under the control of the control section 13, first, the conveying section 3 conveys the recording medium to the record starting position, and then the moving section 7 moves the carriage 6 over the recording medium in the main scanning direction A. Since the color ink head 8 moves with the movement of the carriage 6, the ink nozzles 9 on the color ink head 8, which are divided into six groups equally, jet the color ink corresponding to the facing bands. After the color ink lands on the medium, the control section 13 causes the light source 12 to radiate ultraviolet rays. Thus, the deposited color ink is cured and fixed, and the control section 13 causes the first scanning to be completed.

When the first scanning has finished and the carriage 6 stops, the second scanning starts. Under the control of the control section 13, after conveying the recording medium by a predetermined amount (one band width) toward the downstream side in the conveying direction X, the moving section 7 moves the carriage 6 along the main scanning direction B. The ink nozzles 9 of the color ink head 8 jet the color ink, corresponding to the facing bands, and the light source 12 radiates ultraviolet rays right after landing of the color ink on the medium, thus the second scanning of image recording ends.

With such scanning repeated up to sixth scanning, the color ink, forming the first band relative to the record starting position, is deposited, and fixed by irradiation of ultraviolet rays. FIG. 5A is a dot-matrix showing by what number of scanning the color ink is deposited on each pixel in the first band. Each square in the matrix shows one pixel, and the number in the square indicates by what number of scanning the ink is deposited.

Thereafter, the conveying section 3 conveys the recording medium by a predetermined amount (one band width), and seventh scanning begins under the control of the control section 13. That is, the recording medium is conveyed to the downstream side in the conveying direction X by the predetermined amount (one band width), and the moving section 7 moves the carriage 6 along the main scanning direction A. At this time, the invisible ink recording head 10 does not jet invisible ink, and the seventh scanning finishes with the end of the movement of the carriage 6.

FIG. 5B is a dot-matrix in a second band relative to the record starting position. This band does not face the color ink recording head 8 in the first scanning, and therefore the jetting of color ink finishes at the seventh scanning.

When the carriage 6 stops after finishing of the seventh scanning, the conveying section 3 moves the recording medium by a predetermined amount (one band width), and eighth scanning starts under the control of the control section 13. Therefore, the moving section 7 moves the carriage 6 in the main scanning direction B, and the ink nozzles 9 on the invisible ink recording head 10, which are divided into six groups equally, jet the invisible ink corresponding to the facing bands while thinning out the ink. Here, the control section 13 causes the noise adding section 15 to jet the invisible ink so that the deposited positions in unit area of the invisible ink become random. The light source 12 radiates ultraviolet rays toward the deposited invisible ink to fix the invisible ink on the color inks, and the eighth scanning finishes.

With repetition of such scanning, the invisible ink is jetted only while the carriage 6 moves in the main scanning direction B, and fixed by irradiation of ultraviolet rays. FIGS. 6A and 6B show the states of respective bands with dots added on pixels having the invisible ink deposited thereon. In FIGS. 6A and 6B, each square has dots in the entire area, but actually, each deposited invisible ink spreads in a near round shape. In the embodiment, the invisible ink is jetted only while the carriage 6 moves in the main scanning direction B, that is, the invisible ink is jetted only in the scanning of even numbers, therefore the number of pixels per unit area for the invisible ink is 0.5 times the number of pixels per unit area for the color ink.

As described above, since the invisible ink is jetted only in one directional scanning in the embodiment, the time from landing of the invisible ink to irradiation by ultraviolet rays becomes constant. Accordingly, the invisible ink can be fixed on the fixed color inks with a uniform dot size, thereby uneven gloss is prevented and image quality is improved.

Further, two kinds of recording heads are mounted on one same carriage 6 and each ink can be jetted during reciprocating movement of the carriage 6, therefore the moving section 7 can be made simple and small-sized, resulting in reduction of cost of the apparatus.

Further, properly thinning out the invisible ink prevents the adjacent invisible inks from connecting with each other on the recording medium, and the invisible ink is resultantly cured and fixed with a uniform dot size, to thereby prevent non-uniformity of gloss and lowering of recording speed. Here, ink quantity per one pixel jetted from the invisible ink recording head 10 is so reduced as to correspond to a gloss level set through the input section 14, therefore the user can record images by a desired level of gloss.

On the assumption that the resolution by the color ink head 8 and the invisible ink recording head 10 are both 720×720 dpi, TABLE 1 shows evaluation of gloss according to the relationship between recorded resolution by the invisible ink recording head 10 and the number of recorded pixels per unit area. Here, the "recorded resolution" in TABLE 1 means the recorded resolution by the invisible ink recording head 10, and the "number of pixels" is a ratio (%) to the maximum number of pixels per unit area recordable by the invisible ink recording head 10 in each recorded resolution. In TABLE 1, "A" indicates a state that non-uniformity in gloss is not found at all, "B" indicates a state that non-uniformity in gloss is found a little and little affected, and "C" indicates a state that non-uniformity in gloss is found and image quality is remarkably deteriorated.

TABLE 1

| RECORDED | NUMBER OF PIXELS | | | | |
|---|---|---|---|---|---|
| RESOLUTION | 100% | 80% | 60% | 40% | 20% |
| 720 × 720 dpi | B | B | B | C | C |
| 720 × 360 dpi | B | A | A | C | C |
| 360 × 360 dpi | B | A | B | C | C |

In the embodiment, the number of scanning necessary for jetting the color ink and the invisible ink to form one band is properly changeable, and an amount of each ink to be thinned out may depend on the number of scanning. As to the methods of thinning out the ink between dots, the number of ink jetting may be reduced, or the ink amount of one jetting may be reduced. In the case of reducing the number of ink jetting, it is possible to reduce the number of times of transferring the drive signal to jet the invisible ink. This method is therefore preferable from the viewpoint of recording speed.

In the embodiment, the recording medium is conveyed by one band after the end of every scanning, but the invention is also applicable to other control methods of the inkjet recording apparatus that record images with other conveying modes. For instance, while the conveying of a recording medium is halted, plural times of scanning may be carried out for jetting the color inks toward the corresponding area facing the recording heads, thereafter the recording medium may be conveyed by a length of the recording head in the conveying direction X.

As to the ink, ultraviolet curable ink is used in the embodiment for recording images, but the ink is not limited thereto. Photo-curable ink, which is cured by irradiation of electromagnetic waves other than ultraviolet rays, may be used, the electromagnetic waves being, for example, ultraviolet rays, electron beam, X rays, visible rays, infrared rays, etc. In this case, the ink employs a polymerization compound that is polymerizable and curable by irradiation of light other than ultraviolet rays, and a photo-initiator that initiates polymerization reaction among polymerization compounds by irradiation of other light. Instead of the light source 12 that radiates ultraviolet rays, a light source that radiates the other light may be employed.

As to recording heads used in the inkjet recording apparatus 1, both on-demand type and continuous type of head may be employed. As to an ink jetting method, any type of jetting method is applicable out of the following methods: electromechanical conversion method (for example, single cavity type, double cavity type, bend mode type, piston type, shear mode type, sheared walls type and the like), electro-thermal conversion method (for example, thermal inkjet type, bubble-jet (registered trade mark) type and the like), electrostatic attraction method (for example, electric field control type, slit-jet and the like), electric discharge method (for example, spark-jet and the like) and the like.

Second Embodiment

Figure 7:
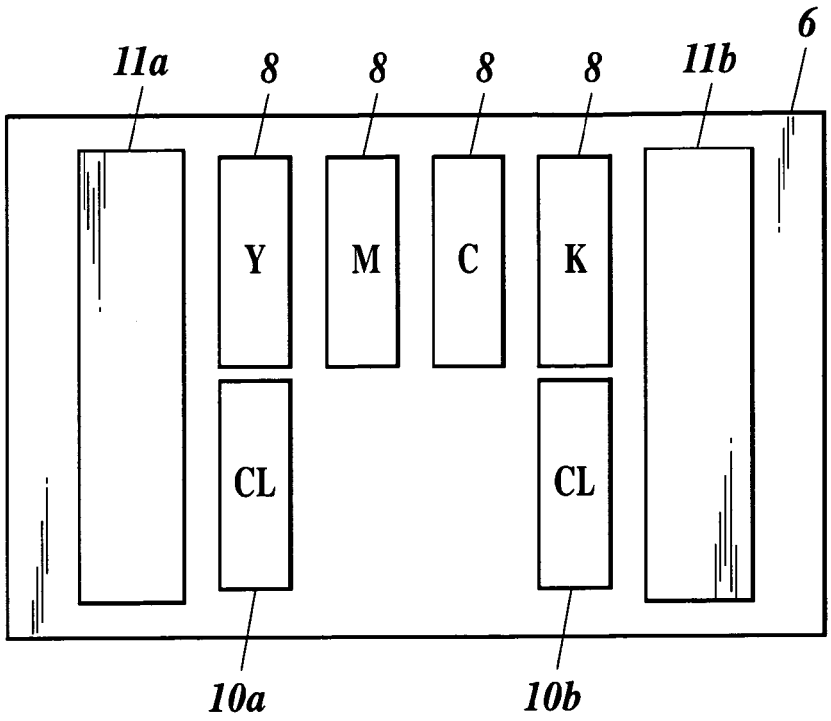
FIG. 7 is a plan view showing a carriage according to a second embodiment of the present invention.

A description will now be given of an inkjet recording apparatus according to a second embodiment of the invention. As shown in FIG. 7, the inkjet recording apparatus of the embodiment differs from the apparatus in the first embodiment in that invisible ink recording heads 10*a* and 10*b* are arranged symmetrically on the carriage 6, and ultraviolet irradiating devices 11*a* and 11*b* mounted on both sides of the heads have an equal distance from the heads 10*a* and 10*b*, respectively.

With this structure, when the moving direction of the carriage 6 is switched, the invisible ink heads 10*a* and 10*b*, and the irradiating devices 11*a* and 11*b*, which are used in bidirectional scanning, are both switched. That is, when the carriage 6 moves in the main scanning direction A, the invisible ink is jetted from the head 10*b* locating at one side with irradiation of ultraviolet rays from the irradiating device 11*b* locating at the rear side in the moving direction. And when the carriage 6 moves in the main scanning direction B, the invisible ink is jetted from the head 10*a* locating at the other side with irradiation of ultraviolet rays from the irradiating device 11*a* locating at the rear side in the moving direction.

By fixing the invisible ink in such a way, the time from jetting of the invisible ink to irradiation of ultraviolet rays becomes uniform, and therefore dot sizes of the deposited invisible ink become uniform to thereby prevent uneven gloss. Additionally, by properly thinning out the invisible ink, adjacent invisible ink dots can be prevented from randomly connecting with each other. Accordingly, in the case that the carriage 6 has a plurality of invisible ink heads 10*a*, 10*b* and the like thereon, almost the same effect as in the first embodiment can be achieved.

Since the distance from the irradiating device 11*a* to the invisible ink heads 10*a* equals that from the device 11*b* to the head 10*b*, it is also possible that, when the carriage 6 moves in the main scanning direction A, the invisible ink is jetted from the head 10*a* with irradiation of ultraviolet rays from the irradiating device 11*b*, and that, when the carriage 6 moves in the main scanning direction B, invisible ink is jetted from the head 10*b* with irradiation of ultraviolet rays from the irradiating device 11*a*. With this method, the same effect can be achieved. With such selection of the invisible ink heads 10*a* or 10*b*, it is possible to adjust the time from landing of the invisible ink to irradiation of ultraviolet rays, therefore the gloss can be adjusted as the user desires.

Figure 8:
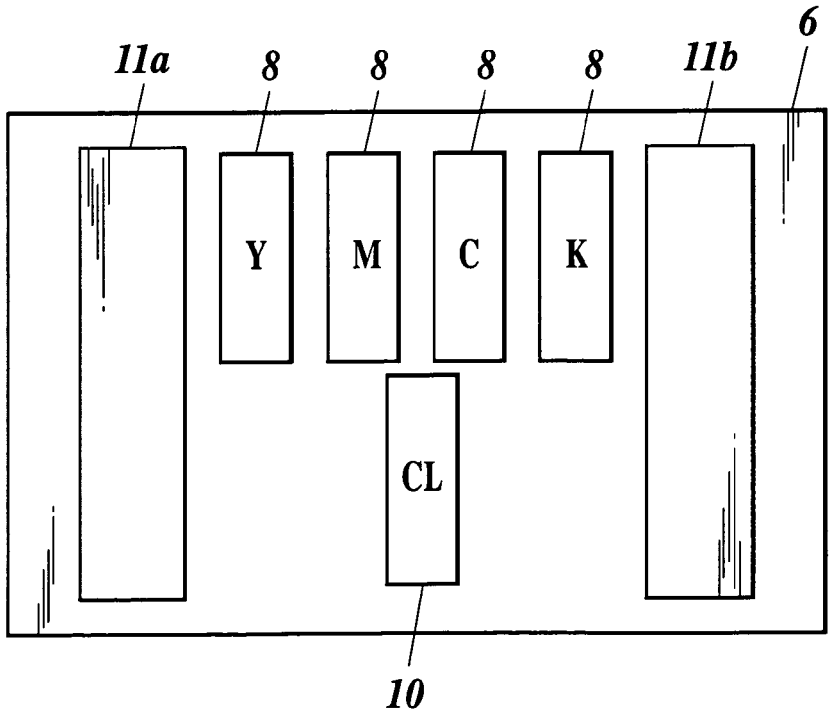
FIG. 8 is a plan view showing a carriage according to the second embodiment of the present invention.

In the embodiment, arrangement of the invisible ink recording head 10 is not limited to the example shown in FIG. 7, but one invisible ink head 10 can be disposed at the center between the ultraviolet irradiating devices 11*a* and 11*b* as shown in FIG. 8.

Third Embodiment

Figure 9:
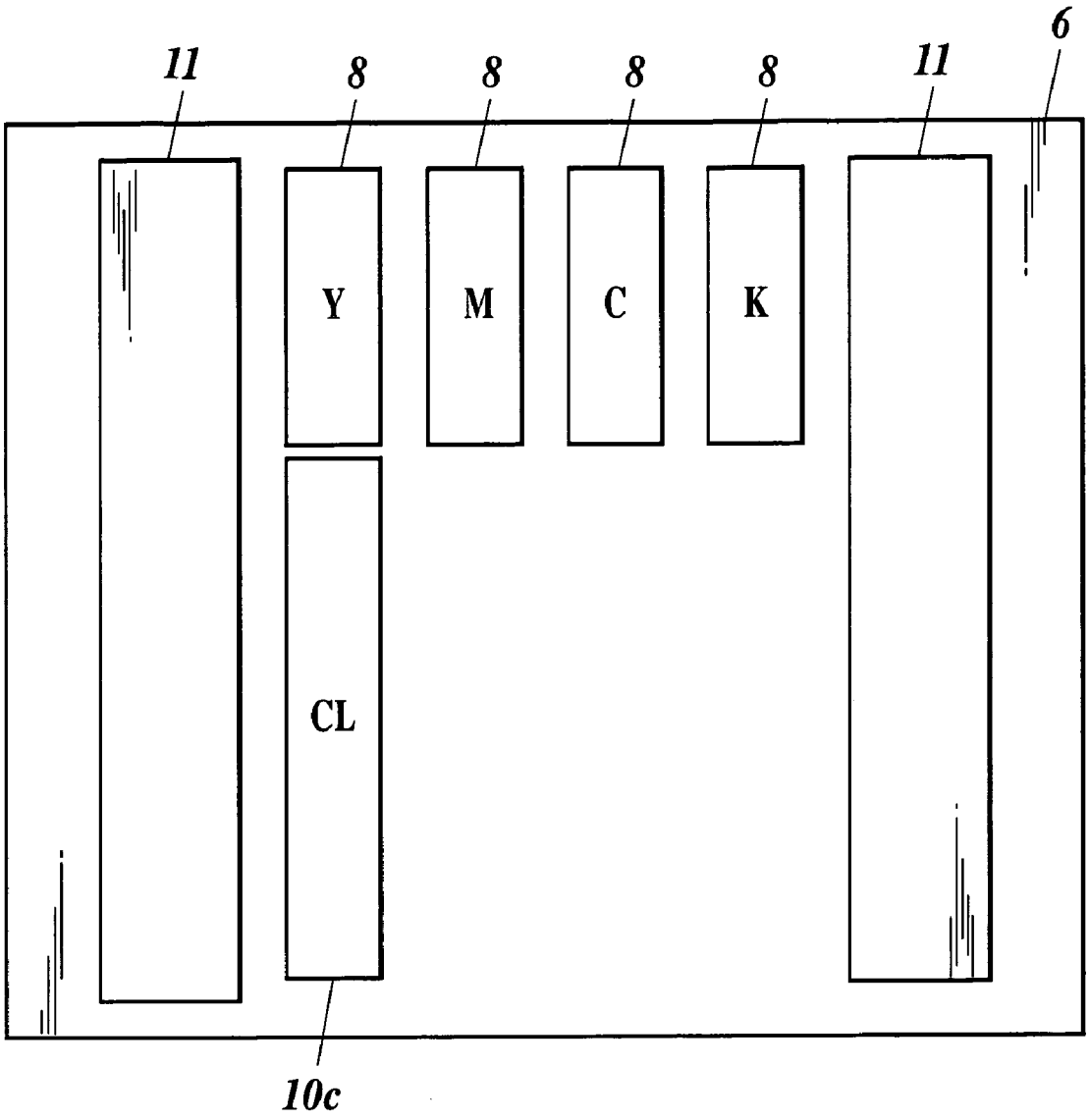
FIG. 9 is a plan view showing a carriage according to a third embodiment of the present invention.

A description will be given of an inkjet recording apparatus according to a third embodiment of the invention. As shown in FIG. 9, the inkjet recording apparatus has an invisible ink recording head 10*c* arranged on the carriage 6, the head 10*c* having almost double length of the color ink recording head 8. The invisible ink is jetted only in one directional scanning of the invisible ink head 10*c* as in the first embodiment.

Accordingly, it is possible to jet the invisible ink on the area, on which the color ink heads 8 jet color inks in bidirectional scanning, from the invisible ink head 10*c* only in one directional scanning. Further, by properly thinning out the invisible ink, adjacent invisible ink dots can be prevented from randomly connecting with each other to obtain uniform gloss, thereby almost the same effect as in the first embodiment can be achieved.

The length of the invisible ink head 10*c* is so formed as to be almost double the length of the color ink head 8 in the embodiment, but it is allowable if the invisible ink is jetted in at least one time of scanning so as to cover double width of one band, on which the color ink head 8 jets color ink droplets. For this reason, if the ink nozzles of the color ink head 8 are divided into a plurality of groups, the invisible ink head 10*c* might jet the invisible ink on the area corresponding to two groups.

What is claimed is:

1. An inkjet recording apparatus comprising:

a carriage movable transversely to a conveying direction of a recording medium;

a color ink recording head mounted on the carriage to jet color ink toward a recording medium;

an invisible ink recording head mounted on the carriage to jet invisible ink toward the recording medium, the invisible ink recording head mounted on the carriage at a downstream side in the conveying direction with respect to the color ink recording head, the invisible ink recording head having a length which is twice as long as a length of the color ink recording head in the conveying direction;

a light irradiating device mounted on the carriage to irradiate light toward the recording medium to cure the ink, the light irradiating device comprises a first light irradiating device and a second light irradiating device which are disposed on opposite sides of the carriage in a transverse direction to the conveying direction, the color ink recording head and the invisible ink recording head placed between the first and second irradiating device, one of the first and second irradiating device has a length equal to or longer than a sum of the length of the color ink recording head and the length of the invisible ink recording head in the conveying direction;

a moving section to reciprocally move the carriage transverse to the conveying direction;

a conveying section to convey the recording medium in the conveying direction; and a control section to perform a control so that while the carriage is moved, the color ink recording head jets the color ink, then the light irradiating device irradiates the color ink with light, and thereafter the invisible ink recording head jets the invisible ink, then the light irradiating device irradiates the invisible ink with light after a lapse of a certain time from the invisible ink jetting.

2. The inkjet recording apparatus of claim 1, wherein the control section controls the color ink recording head to jet the color ink in a bidirectional scanning in a reciprocating movement by the moving section, and controls the invisible ink recording head to jet the invisible ink only in one directional scanning in the reciprocating movement by the moving section.

3. The inkjet recording apparatus of claim 2, wherein the control section performs a control so that a length of an area in a conveying direction, on which the invisible ink is jetted by the invisible ink recording head, in one time of scanning is almost double a length of an area in the conveying direction on which the color ink is jetted by the color ink recording head.

4. An inkjet recording apparatus comprising:

a carriage movable transversely to a conveying direction of a record medium, a color ink recording head mounted on the carriage to jet color ink toward a recording medium;

an invisible ink recording head mounted on the carriage to jet invisible ink toward the recording medium, the invisible ink recording head mounted on the carriage at a downstream side in the conveying direction with respect to the color ink recording head;

a light irradiating device to irradiate light toward the recording medium to cure the ink, the light irradiating device comprises a first light irradiating device and a second light irradiating device which are disposed on opposite sides of the carriage in a transverse direction to the conveying direction, the color ink recording head and the invisible ink recording head placed between the first and second irradiating device, each of the first and second irradiating device has a length equal to or longer than a sum of the length of the color ink recording head and the length of the invisible ink recording head in the conveying direction, and a first distance between the first light irradiating device and the adjacent invisible ink recording head in a direction transverse to the conveying direction and a second distance between the second light irradiating device and the adjacent invisible ink recording head in a direction transverse to the conveying direction are the same;

a moving section to reciprocally move the carriage transverse to the conveying direction;

a conveying section to convey the recording medic in the conveying direction; and a control section to perform a control so that while the carriage is moved, the color ink recording head jets the color ink, then the light irradiating device irradiates the color ink with light, and thereafter the invisible ink recording head jets the invisible ink, then the light irradiating device irradiates the invisible ink with light after a lapse of a certain time from the invisible ink jetting.

5. The inkjet recording apparatus of claim 4, wherein the invisible ink recording head comprises a first invisible ink recording head and a second invisible ink recording head which are mounted on the carriage symmetrically with respect to an intermediate center line between the first light irradiating device and the second light irradiating device.

6. The inkjet recording apparatus of claim 5, wherein the control section controls scanning to switch from a first pair of the first invisible ink recording head and the first light irradiating device to a second pair of the second invisible ink recording head and the second light irradiating device or vise versa in each scanning, the first pair and the second pair are used in forward and backward directions of scanning, respectively.

7. The inkjet recording apparatus of claim 4, wherein the invisible ink recording head comprises a single head of invisible ink recording head, the single head is mounted on the carriage at an intermediate center line between the first light irradiating device and the second light irradiating device.

8. The inkjet recording apparatus of claim 7, wherein the control section controls scanning to switch from the first light irradiating device to the second light irradiating device or vise versa in each scanning, the first light irradiating device and the second light irradiating device are used in forward and backward directions of scanning, respectively.

9. The inkjet recording apparatus of claim 1, wherein the control section controls the number of pixels per unit area recorded by the invisible ink recording head so as to be 0.6-0.8 times the maximum number of pixels per unit area recordable by the invisible ink recording head.

10. The inkjet recording apparatus of claim 1, wherein the control section controls the number of pixels per unit area recorded by the invisible ink recording head so as to be not more than 0.5 times the maximum number of pixels per unit area recordable by the color ink recording head.

11. The inkjet recording apparatus of claim 1, wherein the control section controls the number of pixels per unit area recorded by the invisible ink recording head so as to be not more than 0.25 times the maximum number of pixels per unit area recordable by the color ink recording head.

12. The inkjet recording apparatus of claim 1, wherein the control section randomly determines a landing position of the invisible ink per unit area jetted from the invisible ink recording head.

13. The inkjet recording apparatus of claim 1, wherein a recorded resolution by the color ink recording head is not less than a recorded resolution by the invisible ink recording head.

14. The inkjet recording apparatus of claim 1, wherein a recorded resolution by the color ink recording head is 2n (n is a natural number) times a recorded resolution by the invisible ink recording head.

15. The inkjet recording apparatus of claim 1, wherein the control section is connected to an input section to input an instruction, and the control section performs a control to change the number of pixels per unit area recorded by the invisible ink recording head based on the instruction from the input section.

16. The inkjet recording apparatus of claim 1, wherein the control section adjusts ink quantity per one pixel by the invisible ink recording head to almost equal to or less than ink quantity per one pixel by the color ink recording head.

17. The inkjet recording apparatus of claim 1, wherein the control section is connected to an input section to input an instruction, and the control section adjusts ink quantity per one pixel by the invisible ink recording head based on the instruction from the input section.

18. The inkjet recording apparatus of claim 4, wherein the control section controls the number of pixels per unit area recorded by the invisible ink recording head so as to be 0.6-0.8 times the maximum number of pixels per unit area recordable by the invisible ink recording head.

19. The inkjet recording apparatus of claim 4, wherein the control section controls the number of pixels per unit area recorded by the invisible ink recording head so as to be not more than 0.5 times the maximum number of pixels per unit area recordable by the color ink recording head.

20. The inkjet recording apparatus of claim 4, wherein the control section controls the number of pixels per unit area recorded by the invisible ink recording head so as to be not more than 0.25 times the maximum number of pixels per unit area recordable by the color ink recording head.

21. The inkjet recording apparatus of claim 4, wherein the control section randomly determines a landing position of the invisible ink per unit area jetted from the invisible ink recording head.

22. The inkjet recording apparatus of claim 4, wherein a recorded resolution by the color ink recording head is not less than a recorded resolution by the invisible ink recording head.

23. The inkjet recording apparatus of claim 4, wherein a recorded resolution by the color ink recording head is 2n (n is a natural number) times a recorded resolution by the invisible ink recording head.

24. The inkjet recording apparatus of claim 4, wherein the control section is connected to an input section to input an instruction, and the control section performs a control to change the number of pixels per unit area recorded by the invisible ink recording head based on the instruction from the input section.

25. The inkjet recording apparatus of claim 4, wherein the control section adjusts ink quantity per one pixel by the invisible ink recording head to almost equal to or less than ink quantity per one pixel by the color ink recording head.

26. The inkjet recording apparatus of claim 4, wherein the control section is connected to an input section to input an instruction, and the control section adjusts ink quantity per one pixel by the invisible ink recording head based on the instruction from the input section.

* * * * *